US007568978B1

(12) United States Patent
Probst

(10) Patent No.: US 7,568,978 B1
(45) Date of Patent: Aug. 4, 2009

(54) CUE STICK TIP APPLICATION AND MAINTENANCE TOOL

(76) Inventor: Frederick Ernest Probst, 1218 Vitalia St., Santa Fe, NM (US) 87505

( * ) Notice: Subject to any disclaimer, the term of this patent is extended or adjusted under 35 U.S.C. 154(b) by 0 days.

(21) Appl. No.: 12/011,119

(22) Filed: Jan. 24, 2008

(51) Int. Cl.
*A63D 15/12* (2006.01)
*B27L 9/00* (2006.01)

(52) U.S. Cl. ..... 473/50; 473/1; 473/35; 30/494

(58) Field of Classification Search ..... 47/35–39, 47/46, 50; 30/494
See application file for complete search history.

(56) References Cited

U.S. PATENT DOCUMENTS

| | | | | | |
|---|---|---|---|---|---|
| 60,503 | A | * | 12/1866 | Gissinger | 473/50 |
| 153,433 | A | * | 7/1874 | Fuller | 473/50 |
| 254,703 | A | * | 3/1882 | Ryan | 30/494 |
| 437,746 | A | * | 10/1890 | Barber | 473/36 |
| 589,225 | A | * | 8/1897 | Schoenleber | 473/50 |
| 840,716 | A | * | 1/1907 | Schroeder | 30/494 |
| 1,021,128 | A | * | 3/1912 | Brecker | 30/494 |
| 1,184,096 | A | * | 5/1916 | Hirst | 473/50 |
| 1,185,762 | A | * | 6/1916 | Bohlig | 30/494 |
| 1,259,136 | A | * | 3/1918 | Rogers | 30/494 |
| 1,279,734 | A | * | 9/1918 | McCarthy | 30/494 |
| 1,381,386 | A | * | 6/1921 | Wojcik | 473/50 |
| 1,534,975 | A | * | 4/1925 | Lindfors | 30/494 |
| 1,763,612 | A | * | 6/1930 | Crookston | 473/49 |
| 4,471,824 | A | * | 9/1984 | Zownir | 144/330 |
| 4,620,370 | A | * | 11/1986 | Zownir et al. | 30/494 |
| 4,827,618 | A | * | 5/1989 | Lynn | 30/374 |
| 4,953,602 | A | * | 9/1990 | Smith | 144/349 |
| 4,987,936 | A | * | 1/1991 | Calabrese | 144/346 |
| 5,027,519 | A | * | 7/1991 | De Vincentis | 30/494 |
| 5,062,636 | A | * | 11/1991 | Rahn | 473/46 |
| 5,129,187 | A | * | 7/1992 | Cain | 451/28 |
| 5,208,985 | A | * | 5/1993 | Carter | 30/494 |
| 5,228,160 | A | * | 7/1993 | Porper | 7/158 |
| 5,545,093 | A | * | 8/1996 | Contestabile et al. | 473/36 |
| 5,887,350 | A | * | 3/1999 | Porper | 30/494 |
| 6,616,540 | B2 | * | 9/2003 | Slacum | 473/36 |
| 6,905,417 | B1 | * | 6/2005 | Tona et al. | 473/36 |
| 7,040,996 | B2 | * | 5/2006 | Grandin | 473/46 |

(Continued)

FOREIGN PATENT DOCUMENTS

| | | | |
|---|---|---|---|
| GB | 2190003 | A * | 11/1987 |

(Continued)

*Primary Examiner*—Mark S Graham
(74) *Attorney, Agent, or Firm*—Daniel Robbins

(57) ABSTRACT

A cue tip tool is a cylindrical jig having a longitudinal bore forming its body into a tube that accepts a cue being tipped. The jig body has three equally positioned slots cut through the tubular wall, and the outer surface of the jig has a collar that squeezes the jig against the cue ensuring that the axis of the cue is aligned with the jig. The end of the jig is a cylindrical surface stepped to a larger diameter, and the stepped cylinder is coaxial with the axis of the jig and the axis of the cue. Three auxiliary units configured to separately engage the jig provide for burnishing the end of the cue's ferrule, positioning the cue tip being installed during gluing, and cleaning the cue tip of accumulated chalk debris, while maintaining accurate alignment of the cue tip with the cue's axis.

13 Claims, 2 Drawing Sheets

U.S. PATENT DOCUMENTS

| | | | | |
|---|---|---|---|---|
| 7,201,665 | B2 * | 4/2007 | Van Etten | 473/50 |
| 7,210,233 | B2 * | 5/2007 | Costain | 30/494 |
| 2001/0029635 | A1 * | 10/2001 | Method | 7/164 |
| 2003/0075032 | A1 * | 4/2003 | Porper | 83/195 |

FOREIGN PATENT DOCUMENTS

| | | | |
|---|---|---|---|
| GB | 2370238 | A * | 6/2002 |

* cited by examiner

CUE STICK TIP APPLICATION AND MAINTENANCE TOOL

BACKGROUND OF THE INVENTION

1. Field of the Invention

This invention relates to accessories for the game of billiards, and in particular to a tool for applying a billiard cue stick tip and for maintaining its condition.

2. Description Relative to the Prior Art

The integrity and condition of the cue stick tip which contacts the cue stick ball during a billiard shot has long been a matter of interest and concern to billiard players. After much experimentation, the cue stick tip of choice is the leather tip, and it is available in a variety of leather materials, shapes and widths. The widths of standard leather commercially available cue stick tips range from 9 mm to 15 mm, usually in 1 mm increments. The player selects a width equal to that of the ferrule of his cue stick, and glues the cue stick tip to the end of the ferrule. The prior art discloses a large variety of tools for use in applying, trimming and cleaning tips. Typical prior art may be seen in the following U.S. patents; U.S. Pat. No. 60,503, "Billiard Cue stick Tip Fastener", U.S. Pat. No. 4,987,936, "Cue stick Tippers", and U.S. Pat. No. 5,228,160, "Cue stick Tip Shaping Tool and File Fabrication Method for Use Therewith".

It is known that for optimum control of the billiard shot, not only the surface condition and body texture of the cue stick tip are important, but the orientation and placement of the cue stick tip relative to the cue stick axis are also major considerations. The present invention provides a novel, simple and effective multi-function tool for precise positioning during installation, and for effective maintenance of a leather billiard cue stick tip.

SUMMARY OF THE INVENTION

A multi-function cue stick tip tool consists of a substantially cylindrical cue stick support jig having a longitudinally extensive bore that fashions the body of the jig into a tube like structure. The bore is dimensioned for accepting insertion of a billiard cue stick whose end is to have a cue stick tip attached or further processed. The jig body is provided with three longitudinal collet like slots through the tubular wall, equally positioned around the circumference of the jig body. A slightly tapered collar riding on the outer surface of the support jig may be positioned along its surface to squeeze the segments of the body of the jig against the surface of the inserted cue stick, ensuring that the axis of the cue stick is held locked in coincidence with the axis of the jig. The end of the jig is a cylindrical surface is stepped to a slightly larger diameter than the body of the jig, and the stepped cylinder is precisely coaxial with the axis of the jig, and hence with the axis of the inserted cue stick. A set of three auxiliary tools configured to engage the stepped end of the jig provide for burnishing the end of the ferrule of the cue stick prior to installing the cue stick tip, supporting and positioning the cue stick tip being installed during gluing, and cleaning the cue stick tip of accumulated chalk debris during use, while maintaining the cue stick tip's surface integrity and symmetrical alignment with the axis of the cue stick.

BRIEF DESCRIPTION OF THE DRAWINGS

The invention will be described with respect to the drawings, of which.

DESCRIPTION OF THE PREFERRED EMBODIMENTS

Figure 1:
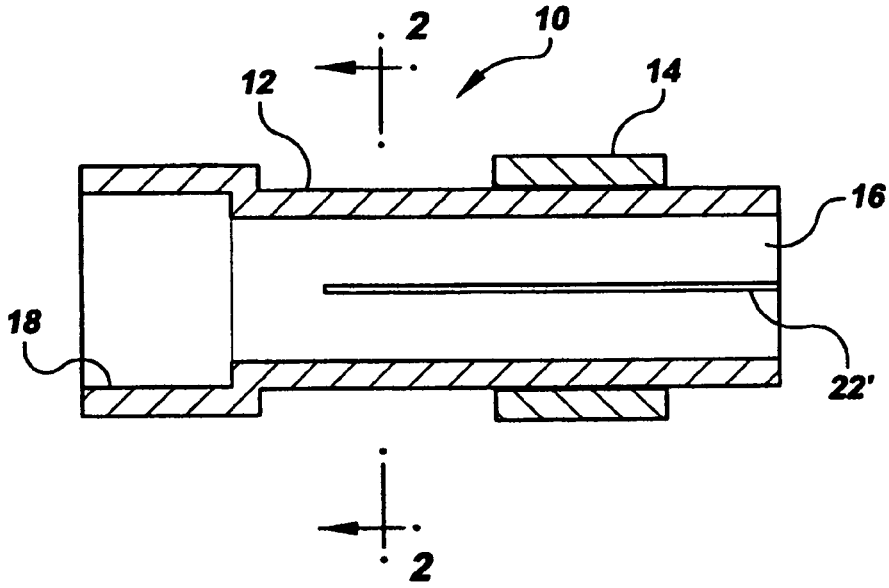
FIG. 1 is a cross-sectional drawing of the support jig including a tightening collar, of the present invention.
Figure 2:
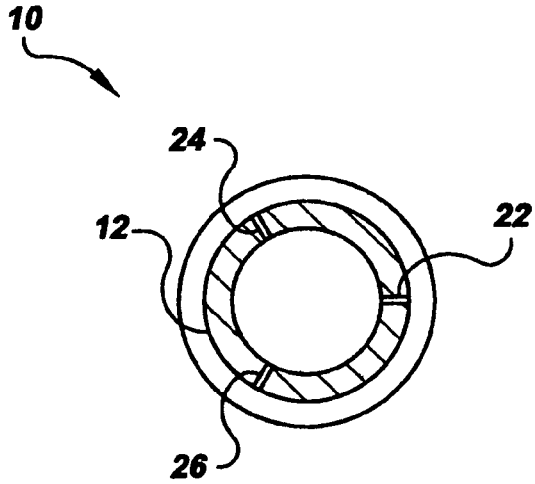
FIG. 2 is a cross-sectional drawing showing an end view of the support jig of FIG. 1 less the tightening collar.

Referring to FIG. 1, a cue stick support jig and tightening collar, 10, is comprised of a support jig body, 12, and tapered moveable tightening collar, 14. Support jig body, 12, and moveable tightening collar, 14, are fabricated from a substantially rigid material of plastic or metal. A suitable material is the plastic Delrin®. The support jig body, 12, is provided with a longitudinal bore, 16, extending the length of the support jig body, 12, and the bore, 16, accurately defines the longitudinal axis of the support jig body, 12 relative to the outer surfaces of the support jig body, 12. In particular, a stepped cylindrical surface, 18, at one end of the support jig body 12, is coaxial with the longitudinal axis of the support jig body, 12. At its other end, the jig support body, 12, has 3 slots, 22, 24, 26, (FIG. 2), positioned at 120 degree angles around the circumference extending longitudinally along the jig support body, 12. When a billiard cue stick, e.g. 20, (FIG. 3), whose cue stick tip end is to be processed, is inserted into the jig support body 12, the tapered moveable tightening collar, 14, is positioned along the cylindrical surface with which it is in contact, forcing the segments of the jig support body, 12, formed by slots 22, 24, 26 into firm contact with the billiard cue stick, e.g. 20 and centering the longitudinal axis of the cue stick, 20, along the axis of the jig support body, 12.

Figure 3:
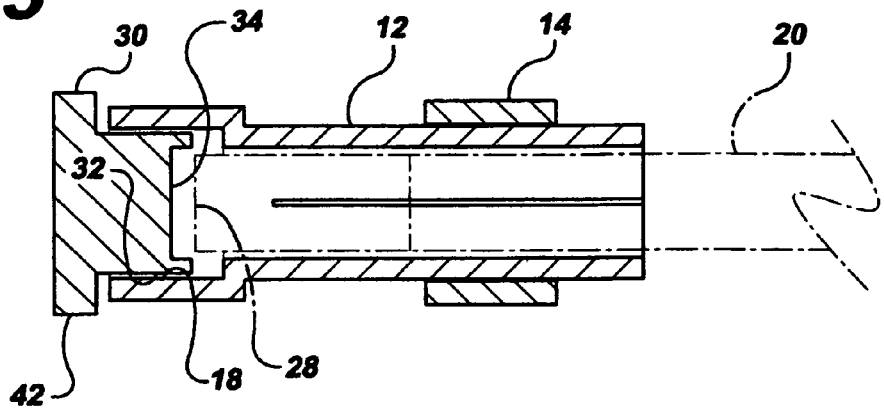
FIG. 3 is a cross-sectional drawing of the support jig and the tightening collar of FIG. 1 affixed to a cue stick inserted in the jig and a first auxiliary tool positioned on the support jig for conditioning the ferrule of the inserted cue stick. Neither the cue stick nor any other elements shown in phantom lines in any of the drawings are included as elements of the present invention, and no claims are asserted involving such elements.

Referring to FIG. 3, a first function of the tool of the invention may be understood, that is, the use of the tool in conditioning the face of the ferrule, 28, prior to attaching a new cue stick tip to the cue stick, 20. With the cue stick, 20, aligned with the axis of the jig support body, 12, as explained above, the first auxiliary tool, 30, is inserted into the opening of the jig support body, 12. The first auxiliary tool, 30, is in the form of a plug like cylinder whose surface, 32, is in sliding contact with the stepped surface, 18, and whose front face, 34, may be forced into contact with the ferrule, 28. Since the cylindrical surface, 32, is parallel to the axis of the cue stick, 20, the front face, 34, of the tool, 30, is perpendicular to the axis of the cue stick, 20, and therefore is parallel to the face of the ferrule, 28. The front face, 34, is provided with an abrasive material such as emery or diamond particles so when the first auxiliary tool, 30, is hand rotated by flange, 42, the face of the ferrule, 28, is cleaned and conditioned to receive a new cue stick tip whose axis will lie along the axis of the cue stick, 20.

Figure 4:
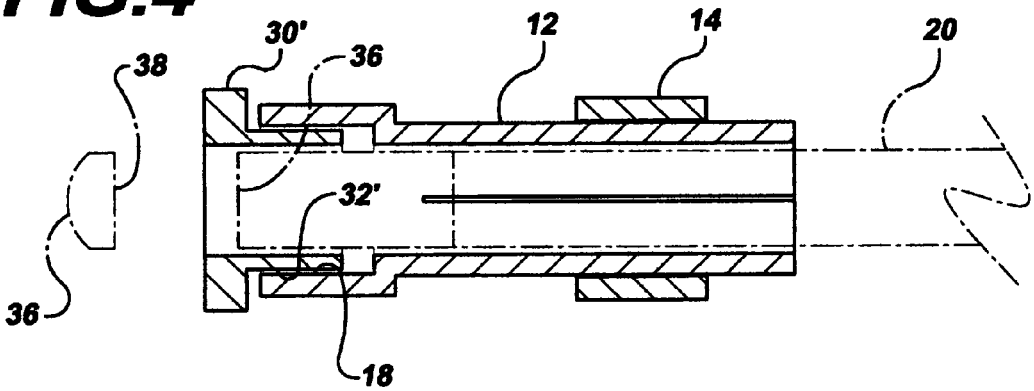
FIG. 4 is a cross-sectional drawing of the support jig and tightening collar of FIG. 1 and a second auxiliary tool positioned on the support jig for aligning and affixing a cue stick tip to the end of the ferrule of the inserted cue stick.

Referring to FIG. 4, a second function of the tool of the invention for accurately affixing a new cue stick tip to the cue stick, 20, may be understood. As described in the above description of the ferrule cleaning function, the jig support body, 12, is aligned with the cue stick, 20, axis and secured by the tightening collar, 14. A second auxiliary tool, 30', similarly formed as a plug like cylinder having a cylindrical surface, 32', is fabricated from a "non-stick" material, such as Teflon®. (In the drawings, different but related elements are identified by the same reference number, albeit the different elements are distinguished by primes. Unprimed elements in the different drawings with the same reference numbers are the same element.) The second auxiliary tool, 30', serves to guide a replacement cue stick tip, 36, so that the cue stick tip rear face, 38, is parallel to the ferrule, 28, face. This ensures that the cue stick tip will be axially symmetrical with the ferrule, 28, face and cue stick, 20, longitudinal axis, upon gluing the cue stick tip rear face, 38, to the ferrule, 28, face. Upon gluing these faces together, any excess glue will not stick to the Teflon® body of the second auxiliary tool, 30' leaving the cue stick tip 36 accurately attached to the cue stick, 20.

Figure 5:
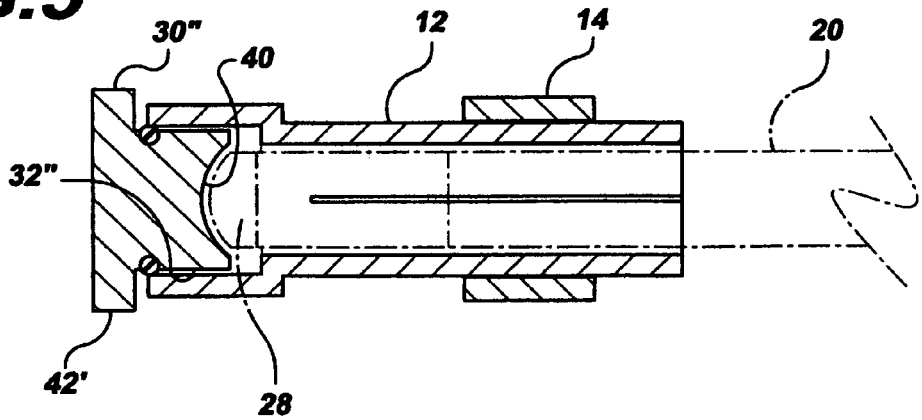
FIG. 5 is a cross-sectional drawing of the support jig and tightening collar of FIG. 1, and a third auxiliary tool positioned on the support jig for conditioning a cue stick tip attached to the inserted cue stick.

Referring to FIG. 5, a third function for cleaning and maintaining the cue stick tip's surface during play, is provided. Chalk is used during play to increase the friction between the cue stick tip, 36, and a cue ball, and with use, an unwanted smooth coating of chalk builds up. A third auxiliary tool, 30", cleans the cue stick tip surface by abrading the built up chalk, and, importantly, does it without distorting the symmetry of the cue stick tip surface or misplacing the cue stick tip axis from alignment with the longitudinal axis of the cue stick, 20. The third auxiliary tool, 30", is a plug-like rigid metal or plastic unit, similar to the first and second auxiliary tools described above, has a cup shaped surface, 40, that conforms with the shape of the front surface of the cue stick tip, 36, and the surface, 40, includes an abrasive material such as emery or diamond particles. As previously stated, it is essential that the cue stick tip, 36, be maintained axially aligned with the cue stick, 20, and therefore the third auxiliary tool, 30", is used in conjunction with the jig support body, 12, when used to abrade built up chalk deposits on the cue stick tip, 36. The jig support body, 12, is affixed to the cue stick, 20, and locked in place by means of the tightening collar, 14, as previously described. With the plug-like third auxiliary tool, 30", inserted into the jig support body, 12, its cylindrical surface, 32", is accurately positioned for sliding contact against the stepped surface, 18, and, accordingly, the cup shaped surface, 40, is in symmetrical alignment for contact with the cue stick tip, 36. By manual rotation of the flange, 42', the abrasive particles in the cup shaped surface, 40, remove caked chalk from the cue stick tip, 36, surface while maintaining the symmetrical integrity of the cue stick tip, 36, and without disturbing its alignment with the axis of the cue stick, 20.

The invention has been described with reference to specific illustrations and examples, but it will be understood that various modifications can be made without departing from the spirit of the principles and teachings of the invention. Accordingly, the invention is limited only by the following claims.

What is claimed is:

1. A portable tool for conditioning the ferrule of a cue stick, said portable tool comprising:

a) a jig support body in the form of a tubular structure having a longitudinal bore there through, said bore having a longitudinal axis of symmetry, said jig support body further having a proximal end and a distal end, said jig support body configured whereby with said cue stick inserted into said bore at said jig support body's distal end the longitudinal axis of said cue stick is positioned along said longitudinal axis of said bore, b) a clamping device positioned on said jig support body whereby with said cue stick inserted into said jig support body said axis of said cue stick is fixedly held in alignment with said axis of said jig body by means of said clamping device, c) a removable cylindrical cap positioned on said proximal end of said jig support body, said cap having a longitudinal axis of symmetry positioned in alignment with said longitudinal axis of said bore, said cap further manually rotatable about said cap's longitudinal axis of symmetry, and d) said cap further comprising an abrasive planar surface perpendicular to said cap's longitudinal axis of symmetry, whereby said planar surface is in contact with said ferrule of said cue, and further whereby when said cap is manually rotated the surface of said ferrule is scored and cleaned by said abrasive planar surface.

2. The portable tool of claim 1 wherein said tubular structure, beginning at said distal end, has three slots cut therein, said slots partially extending the length of said jig support body, and said slots angularly separated from each other by 120 degrees.

3. The portable tool of claim 1 wherein said clamping device is a hollow cylinder, said hollow cylinder having a tapered inner cylindrical surface, whereby when said hollow cylinder is positioned on said jig support body it forces said tubular structure into firm contact with said cue.

4. A portable tool for conditioning the cue tip of a cue stick, said portable tool comprising:

a) a jig support body in the form of a tubular structure having a longitudinal bore there through, said bore having a longitudinal axis of symmetry, said jig support body further having a proximal end and a distal end, said jig support body configured whereby with said cue stick inserted into said bore at said jig support body's distal end the longitudinal axis of said cue stick is positioned along said longitudinal axis of said bore, b) a clamping device positioned on said jig support body whereby with said cue stick inserted into said jig support body said axis of said cue stick is fixedly held in alignment with said axis of said jig body by means of said clamping device, c) a removable cylindrical cap positioned on said proximal end of said jig support body, said cap having a longitudinal axis of symmetry positioned in alignment with said longitudinal axis of said bore, said cap further manually rotatable about said cap's longitudinal axis of symmetry, and d) said cap further comprising an abrasive concave surface having an axis of symmetry aligned said cap's longitudinal axis of symmetry, whereby said abrasive surface is in contact with said cue tip of said cue, and further whereby when said cap is manually rotated the surface of said cue tip is scoured and cleaned by said abrasive concave surface.

5. The portable tool of claim 4 wherein said tubular structure, beginning at said distal end, has three slots cut therein, said slots partially extending the length of said jig support body, and said slots angularly separated from each other by 120 degrees.

6. The portable tool of claim 4 wherein said clamping device is a hollow cylinder, said hollow cylinder having a tapered inner cylindrical surface, whereby when said hollow cylinder is positioned on said jig support body it forces said tubular structure into firm contact with said cue.

7. The portable tool of claim 4 wherein the abrasive of said abrasive surface is comprised of diamond particles or emery particles.

8. A multi-purpose portable tool for use with a cue stick, said cue stick further comprising a ferrule thereon, said tool comprising:

a) a jig support body in the form of a tubular structure having a longitudinal bore there through, said bore having a 1st longitudinal axis of symmetry, said jig support body further having a proximal end and a distal end, said jig support body configured whereby with said cue stick inserted into said bore at said jig support body's distal end the longitudinal axis of said cue stick is positioned along said 1st longitudinal axis of said bore, b) a clamping device positioned on said jig support body whereby with said cue stick inserted into said jig support body said axis of said cue stick is fixedly held in alignment with said 1st longitudinal axis of said bore by means of said clamping device, c) a 1st removable cylindrical cap positionable on said proximal end of said jig support body, said cap having a 2nd longitudinal axis of symmetry positioned in alignment with said 1st longitudinal axis of said bore, said 1st removable cap further manually rotatable about said cap's 2nd longitudinal axis of symmetry, d) said 1st cap further comprising an abrasive planar surface perpendicular to said 1st cap's 2nd longitudinal axis of symmetry, whereby said planar surface is in contact with said ferrule of said cue, and further whereby when said 1st cap is manually rotated the surface of said ferrule is scoured and cleaned by said abrasive planar surface, e) a 2nd removable cylindrical cap positionable on said proximal end of said jig support body, wherein said cap has a 3rd longitudinal axis of symmetry positioned in alignment with said 1st longitudinal axis of said bore, said 2nd cap further manually rotatable about said 2nd cap's 3rd longitudinal axis of symmetry, and wherein the interior surface of said 2nd cap is a substantially hollow cylindrical surface, said 1st hollow cylindrical surface symmetrically positioned with respect to said 2nd cap's 3rd longitudinal axis of symmetry, said hollow cylindrical surface configured to conform to the geometry of said cue tip, and f) further wherein said 2nd cap and said hollow cylindrical surface are fabricated from a non-stick material, whereby when an adhesive is applied to said cue tip to cause said cue tip to adhere to said ferrule, said adhesive does not adhere to said hollow cylindrical surface of said 2nd cap, said cue tip being held in contact with said ferrule during bonding by manual pressure against said 2nd cap, g) a 3rd removable cylindrical cap positionable on said proximal end of said jig support body, said 3rd cap having a 4th longitudinal axis of symmetry positioned in alignment with said 1st longitudinal axis of said bore, said 3rd cap further manually rotatable about said 3rd cap's 4th longitudinal axis of symmetry, and h) said 3rd removable cap further comprising an abrasive concave surface having a 5th longitudinal axis of symmetry aligned along said 3rd cap's 4th longitudinal axis of symmetry, whereby said abrasive concave surface is in contact with said cue tip of said cue, and further whereby when said cap is manually rotated the surface of said cue tip is scoured and cleaned by said abrasive concave surface.

9. The multi-purpose portable tool of claim 8 wherein said tubular structure, beginning at said distal end, has three slots cut therein, said slots partially extending the length of said jig support body, and said slots angularly separated from each other by 120 degrees.

10. The multi-purpose portable tool of claim 8 wherein said clamping device is a hollow cylinder, said hollow cylinder having a tapered inner cylindrical surface, whereby when said hollow cylinder is positioned on said jig support body it forces said tubular structure into firm contact with said cue.

11. The portable tool of claim 8 wherein said non stick material is Teflon®.

12. The portable tool of claim 8 wherein the abrasive of said abrasive surface is comprised of diamond or emery particles.

13. The portable tool of claim 8 wherein said jig support body is made of Delrin®.

* * * * *